United States Patent [19]

Brouard et al.

[11] 4,145,898

[45] Mar. 27, 1979

[54] INSTALLATION FOR THE TREATMENT OF A FABRIC IMPREGNATED WITH A LIQUEFIED GAS

[75] Inventors: Dominique Brouard; Guy Doucin, both of Thann, France

[73] Assignee: Air Industrie, Courbevoie, France

[21] Appl. No.: 839,182

[22] Filed: Oct. 4, 1977

[30] Foreign Application Priority Data

Oct. 13, 1976 [FR] France ..... 76 30768
Jun. 10, 1977 [FR] France ..... 77 17895

[51] Int. Cl.[2] ..... D06B 3/12; D06B 23/22

[52] U.S. Cl. ..... 68/15; 68/18 R; 68/18 C; 68/22 R; 68/62; 68/181 R; 68/184

[58] Field of Search ..... 68/13 R, 15, 18 R, 18 F, 68/18 C, 184, 62, 181 R, 22 R; 55/208

[56] References Cited

U.S. PATENT DOCUMENTS

| | | | |
|---|---|---|---|
| 2,288,949 | 7/1942 | Hinnekens | 68/158 |
| 3,889,390 | 6/1975 | Klare | 68/18 R X |
| 3,955,386 | 5/1976 | Meier-Windhorst | 68/15 X |

*Primary Examiner*—Philip R. Coe
*Attorney, Agent, or Firm*—Larson, Taylor and Hinds

[57] ABSTRACT

This installation for the treatment of a fabric impregnated with a liquefied gas comprises a treatment tank containing a treating bath, means for conveying the fabric through the treating bath, means for heating the treating bath over all or part of the path of travel of the fabric and a degassing device independent of the treatment tank and connected thereto by pipes for the circulation of the treating bath.

16 Claims, 3 Drawing Figures

INSTALLATION FOR THE TREATMENT OF A FABRIC IMPREGNATED WITH A LIQUEFIED GAS

The present invention relates to installations for treating a fabric impregnated with a liquefied gas.

It is in fact known that the impregnation of a fabric with a liquefied gas (particularly liquid ammonia) offers a certain number of advantages, in particular as far as the acceleration of further improvement treatments are concerned (dyeing, finishing for example).

It is also known that, to eliminate the liquefied gas having served for the impregnation of the fabric, a treatment can be used in which the fabric is impregnated in an aqueous treating bath, preferably hot.

During the immersion in the hot aqueous treating bath, the transfer of heat from the bath to the fabric, more rapid than the transfer of liquefied gas from the fabric to the bath, causes a very rapid vaporisation of the liquefied gas impregnating the fabric and brings about considerable local cooling of the treating bath.

This cooling reduces the efficiency of the treatment bath, especially if this bath fulfils a subsidiary role, e.g. if it is a bath ensuring in addition the dyeing of the fabric.

Moreover, a part of the liquefied gas being vaporised will be dissolved in the treating bath which will then be the seat of a degassing phenomenon. Now, this bath may contain, in solution, sizing products coming from the fabric; these products are formed of macromolecules having a surface-active character, which, during degassing, cause the formation of stable and tenacious foam which rapidly invades the installation and overflows towards the machines which precede or which follow the installation.

The invention has as its aim to remedy these two disadvantages which have just been discussed, i.e.: cooling of the treating bath and the formation of stable and tenacious foam.

Generally in accordance with the invention, an installation for the treatment of a fabric impregnated with a liquid gas comprises a treatment tank containing a treating bath, conveying means for conveying the fabric through the treating bath, heating means, for heating the treating bath, provided over all or part of the path of travel of the fabric, and degassing means constituted by a degassing device independent of the treatment tank and connected thereto by pipes for the circulation of the treating bath, said degassing device comprising a re-heating device acting directly on treating bath circulating therethrough for both re-heating and regenerating said treating bath through stripping of gas dissolved therein from the impregnated fabric before the bath is returned to the treatment tank.

The means for heating the treating bath are advantageously arranged so that its temperature is higher towards the fabric outlet than towards the fabric inlet.

Preferably, this degassing device comprises a filter.

According to an advantageous arrangement of the invention, this degassing device comprises means for correcting the composition of the treating bath.

In accordance with one particular embodiment of the invention, the treatment tank is formed by several elementary sections or tanks in cascade, the treating bath overflowing from one to the other.

According to another advantageous arrangement of the invention, the means for re-heating the bath are formed by two superposed heat exchangers disposed in the degassing device. The upper heat exchanger working at a lower temperature than the operating tmperature of the lower heat exchanger.

In this case, it is to be noted that if the degassing device is not sufficiently sealed from the surrounding air, the two heat exchangers which it houses will not have a noticeable action on the air content of the gaseous mixture recovered.

To obtain more efficient cooling and so a better separation of the air while still reducing the air content of the gaseous mixture recovered, the installation may comprise connection means between the upper part of the treatment tank and the degassing device, these connecting means finishing in the degassing device between the upper heat exchanger and the lower heat exchanger.

Preferably these connecting means comprise a complementary heat supply device which may particularly be formed by an electrical resistance or by a coil through which hot fluid flows; this extra heat supply device avoids condensation especially in the horizontal or slightly tilted parts of said connecting means.

The upper heat exchanger is advantageously formed by a condenser of the type with "packing."

The lower heat exchanger is advantageously formed by a falling film evaporator.

The invention will, in any case, be well understood with the help of the complement of description which follows, as well as the accompanying drawings, which complement and drawings relate to preferred embodiments of the invention and have, of course, no limiting character.

FIG. 1 of these drawings is a longitudinal schematical section of an installation according to a first embodiment of the invention.

Figure 1:
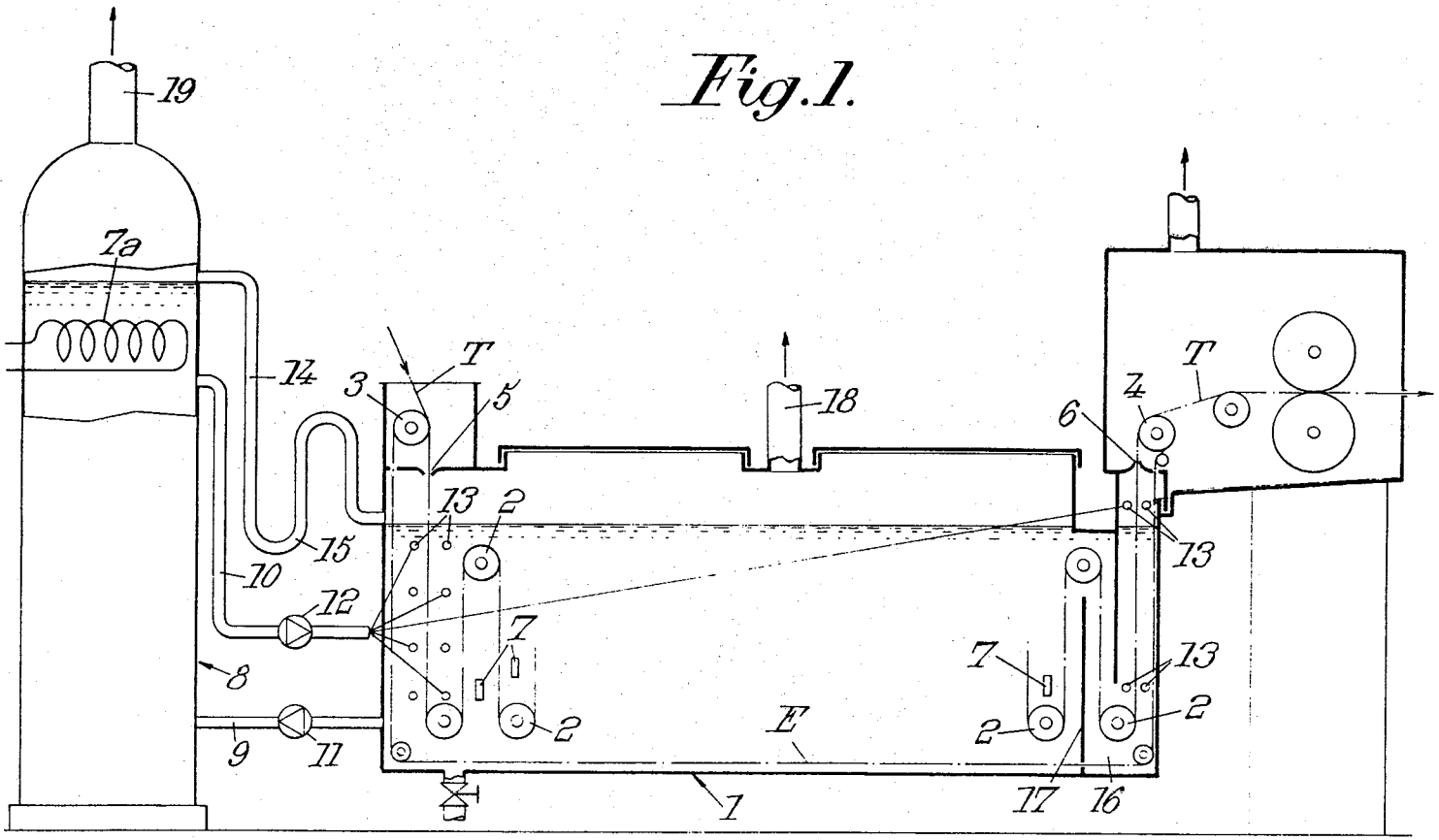

The installation according to the embodiment shown in FIG. 1 comprises a treatment tank 1 containing the treating bath.

Means for conveying the fabric T through this treating bath are provided, these means being formed for example by two rollers 2 disposed in the treatment tank 1 so that the conveyance of the fabric is carried out in vertical lengths. An input roller 3 and an output roller 4 are disposed respectively near the inlet 5 and the outlet 6 for fabric T in the treatment tank 1.

These means for conveying the fabric T through the treating bath may be completed by a loading link E for introducing and conveying the front end of fabric strip T during start-up of the installation.

Means are provided for heating the treating bath over all or part of the path of travel of fabric T, these means being for example formed by heaters 7 placed near fabric T. Thses heating means are arranged so that the temperature of the treating bath is higher towards outlet 6 for fabric T than towards its inlet 5. These heaters 7 are of any appropriate type (tubes through which flows hot fluid, tubes in which a pure vapour condenses, for example).

A degassing device 8 independent of treatment tank 1 is provided, this degassing device 8 being connected to treatment tank 1 by pipes 9 and 10 for circulation of the treating bath, preferably with an adjustable flow obtained by conventional means (valves, variable-delivery pumps, for example).

Pipe 9, provided with a pump 11, transfers the treating bath to be regenerated from the bottom of treatment tank 1 to the degassing device 8. Pipe 10 provided with a pump 12 transfers the regenerated treating bath from the degassing device 8 to treatment tank 1, this pipe 10 supplying a plurality of manifolds 13 situated close to fabric T, along its path of travel.

It was pointed out above that means for heating the treating bath over all or part of the path of travel of the fabric could be formed by heaters 7.

It is fitting to point out now that, according to an advantageous arrangement of the invention, these heating means may be formed also by a re-heater 7a acting directly on the regenerated treating bath before it is distributed in the treatment tank 1 by manifolds 13. The supply of calories is then provided all along the path of travel of fabric T and in the immediate vicinity of fabric T. This re-heater 7a can form part of the structure of the degassing device 8.

An additional pipe 14, provided with a trap 15, connects the part of treatment tank 1, situated above the level of the treating bath, to degassing device 8. This additional pipe 14, with its trap 15, allows the possible over-flow which may have accumulated in the degassing device, to be returned to treatment tank 1.

Near outlet 6 of fabric T there is provided a zone 16 in the treatment tank 1 in which the treating bath is brought to a higher temperature than that of the rest of treatment tank 1. One or more separating walls 17 are provided for isolating this hot zone 16, possibly for dividing it into several compartments Treatment tank 1 is provided, in its upper part situated above the level of the treating bath, with a chimney 18 finishing in a recompression device (not shown). Degassing device 8 is provided, in its upper part, with a chimney 19 also finishing at this recompression device.

The temperature of the treating bath in hot zone 16 may be about 95° for a treating bath adapted for the treatment of a fabric impregnated with liquid ammonia. In the rest of the treating bath, the temperature may be about 50° to 65°. Thus the concentration of ammonia in the treating bath, which risks being carried outside through the outlet for fabric T, is reduced.

This heating of hot zone 16 may be provided by injection of hot water, steam, or by a supplementary reheater.

Figure 2:
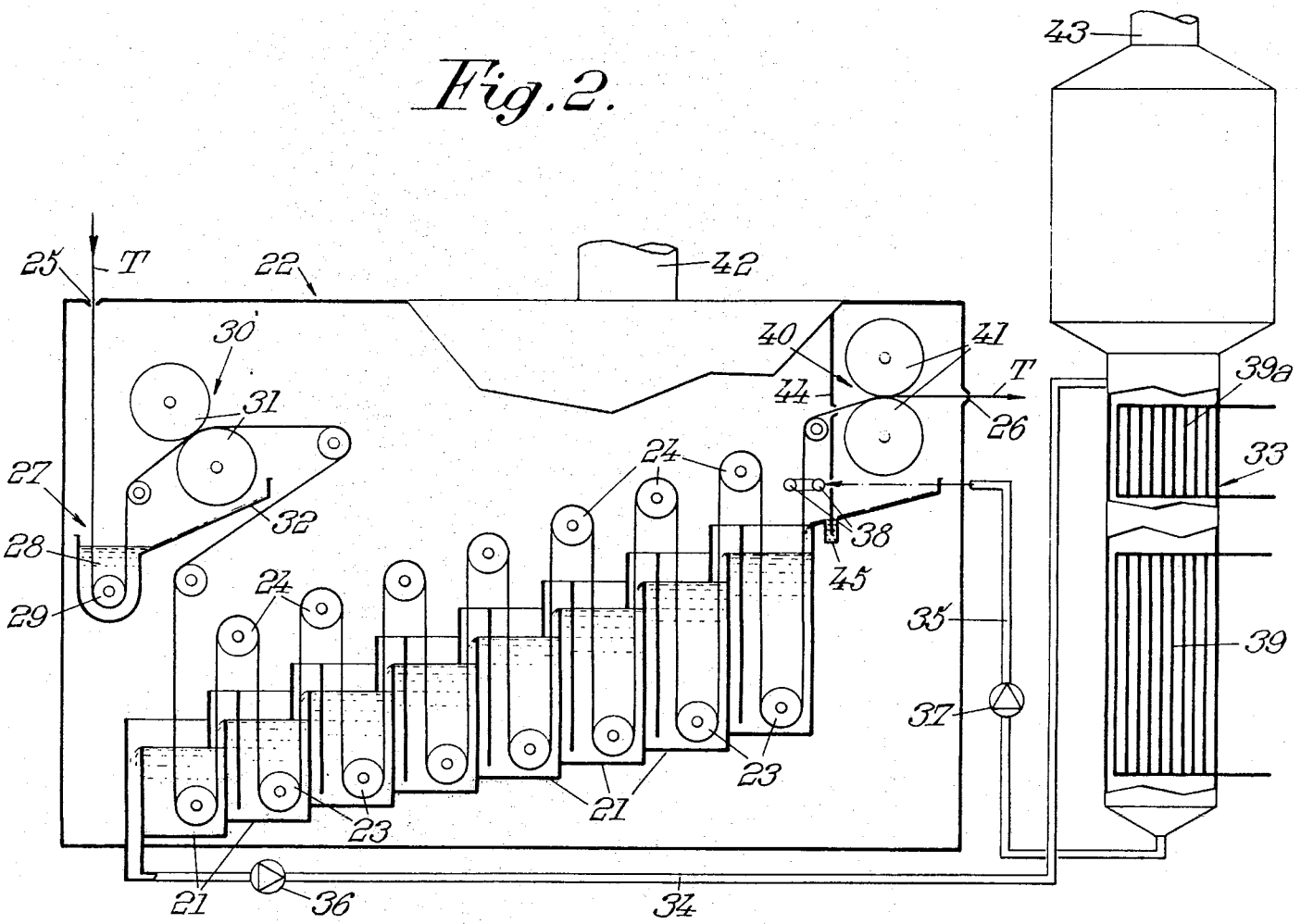
FIG. 2 is a longitudinal schematical section of an installation according to another embodiment of the invention.
Figure 3:
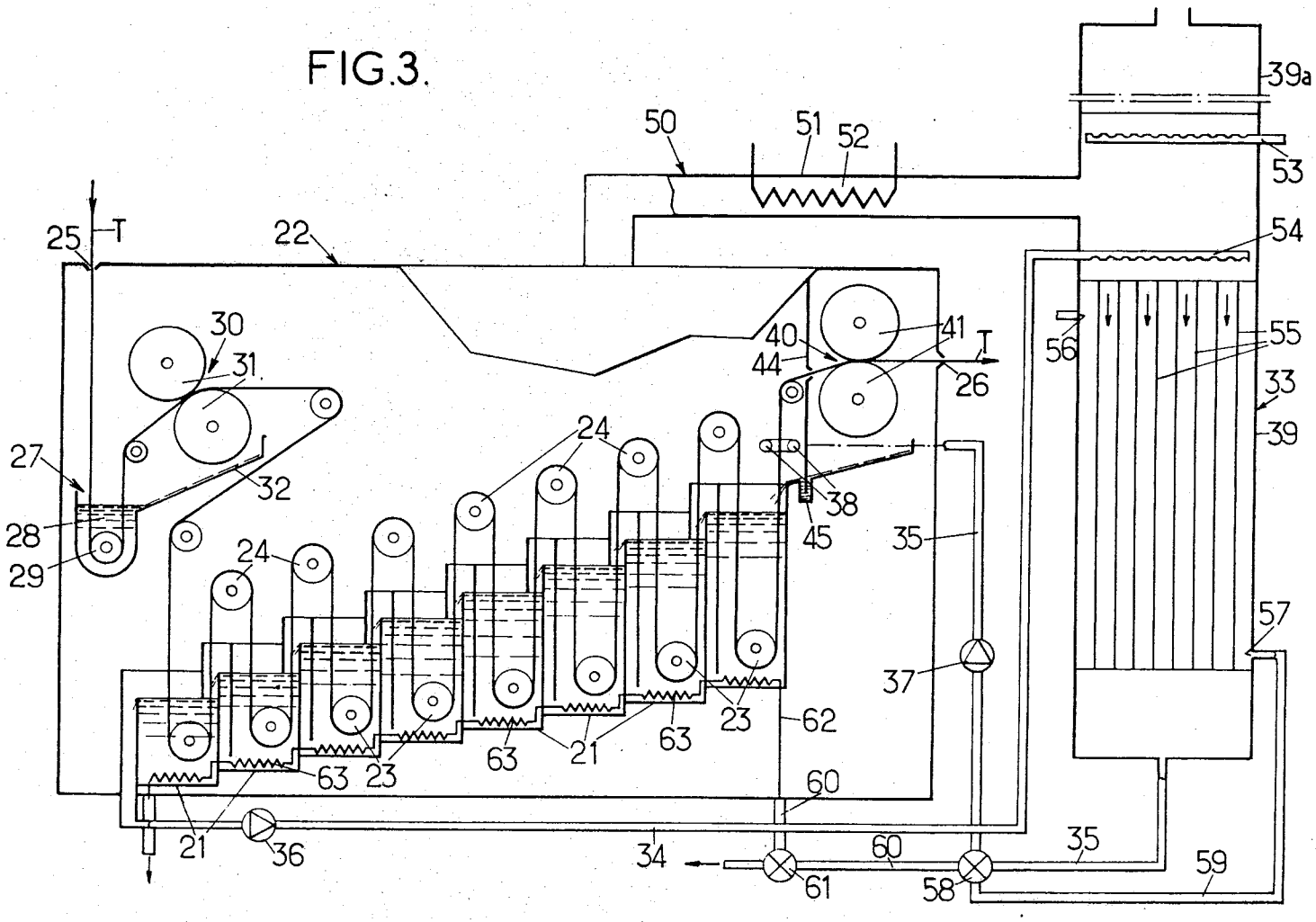
FIG. 3 is a horizontal schematical view of an installation in accordance with yet another embodiment of the invention.

The installation in accordance with the embodiments shown in FIGS. 2 and 3 comprises several elementary treatment tanks 21, each containing a treating bat and mounted in cascade so that the treating bath overflows from one to the other.

These elementary treatment tanks 21 are housed in a treatment tank 22.

Means for conveying fabric T through the treating bath divided among the elementary treatment tanks 21 are provided. These means may be formed by rollers 23 disposed in the treating bath at the lower part of the elementary treatment tanks 21 and by rollers 24 disposed above the elementary treatment tanks 21.

Fabric T enters treatment tank 22 through an inlet 25 and leaves through an outlet 26.

An auxiliary impregnation device 27 may be provided between the inlet 25 for fabric T and the lower elementary treatment tank 21, this auxiliary impregnation device 27 comprising an impregnation vat 28 and a guide roller 29 at the lower part of said impregnation vat 28.

An inlet drying device 30 may be provided between the auxiliary impregnation device 27 and the lower elementary treatment tank 21, this drying device 30 squeezing out part of the liquified gas retained in fabric T. This drying device comprises two drying rollers 31 disposed above a collection wall 32 finishing at impregnation vat 28.

Means for ensuring the conveyance of fabric T through the treating bath may be completed by a loading link (not shown in FIG. 2 for the sake of clarity) for the introduction and the conveyance of the front end of fabric strip T during start-up of the installation.

Means for heating the treating bath over all or part of the path of travel of fabric T are arranged so that the temperature of the treating bath is higher towards outlet 26 for fabric T than towards its inlet 25.

A degassing device 33 independent of treatment tank 22 is provided, this degassing device 33 being connected to the treatment tank 22 by pipes 34 and 35 for the circulation of the treating bath, preferably with an adjustable flow obtained by conventional means (valves, variable-delivery pump, for example).

Pipe 34, provided with a pump 36, transfers the treating bath to be regnerated from the bottom of the lower elementary treatment tank 21 to degassing device 33.

Pipe 35, provided with pump 37, transfers the regenerated treating bath from degassing device 33 to the top of the upper elementary treatment tank 21, this pipe 35 supplying one or more manifolds 38 situated close to fabric T.

In the lower part of degassing device 33, from where pipe 35 leaves for transferring the regenerated treating bath towards treatment tank 22, there is provided a re-heater 39 acting on the regenerated treating bath before it is distributed in the treatment tank 22 by manifolds 38. As in the preceding embodiment, the supply of calories is provided in the immediate vicinity of fabric T.

This degassing device 33 is formed, preferably, by an evaporating apparatus with liquid falling in the form of a film, this apparatus comprising two superposed reheaters 39 and **39*a*** adjustable independently of each other.

The upper re-heater **39*a* operates at a lower temperature than the operating temperature of lower re-heater 39**.

The treating bath to be regenerated arrives at the top of degassing device 33, so as

- to travel first of all over the upper re-heater **39*a*** (the less hot) where it loses a part of the dissolved ammonia without involving too much water whose vapour tension is low above the solution,
- and to then travel over the lower re-heater 39 (the hottest) having lost part of its ammonia, the water vapour tension then increasing considerably but the vapourised water will condense in the cold circuit, while being separated from the ammonia which will be directed towards a recompression device.

It will be noted that the quantity of the treating bath (water) acting by dissolution and passing from one circuit to the other, remains negligible in relation to the amount of the two fluids present.

An outlet drying device 40 may be provided between the upper elementary treatment tank 21 and outlet 26 for fabric T, this drying device 40 squeezing out a part at least of the treating bath retained in fabric T. This drying device comprises two drying rollers 41.

The space which houses the outlet drying device 40 may be possibly separated from the inner space of treatment tank 22 by a separating wall 44 whose lower edge is immersed in a liquid joint 45 permanently fed by the liquid squeezed out from fabric T by rollers 41 of the outlet drying device 40.

Treatment tank 2 is provided, in its upper part, with a chimney 42 finishing at a recompression device (not shown).

The degassing device 33 is provided, in its upper part, with a chimney 43 also finishing at this recompression device.

In accordance with the embodiment shown in FIG. 3, connection means 50 are provided to connect the upper part of treatment tank 22 and degassing device 33, these connecting means 50 finishing in the degassing device 33 between the upper heat exchanger 39A and the lower heat exchanger 39. These connection means 50, which may be formed by one or more pipes 51, preferably insulated, comprise advantageously a complementary heat supply device 52 (electrical resistance, or coil through which flows a hot fluid).

Thus condensation is avoided, especially in the horizontal or slightly tilted parts of the pipe(s) 51.

The upper heat exchanger **39*a* is advantageously formed by a condenser with packing whose base is fed through a liquid ammonia injection device 53**.

This condenser with packing comprises, as is known per se, inert bodies having a large specific surface such as Raschig rings, Berl saddles or metal trelliswork of stainless steel wires so as to improve the transfer of gas to be recovered between the condensed liquids in the exchanger **39*a* and the vapours co ming at one and the same time from exchanger 39 and from tank 22 through pipe 50**.

This liquid ammonia injection device 53 serves to improve the separation of steam and ammonia vapour in exchanger **39*a***, both by lowering therein the average operating temperature and by increasing therein the molar fraction of ammonia recycled in the vapours collected at the top of the exchanger, so that the amount of water that they contain remains permanently preferably less than 5% by weight.

The lower heat exchanger 39 is advantageously formed by a falling film evaporator, comprising, at its top, a distributor 54 adapted to deliver the liquid on a vertical bundle of evaporation tubes 55 around which a flow of water and/or steam is established between an inlet 56 and an outlet 57.

Pipe 35 comprises a four-way valve 58 which is connected, through a pipe 59, to the outlet 57 of the lower heat exchanger 39. The elementary treatment tanks 21 are then fed with regenerated treating bath (through pipe 35) and with steam condensate (through pipe 59).

This four-way valve 58 is also connected through a pipe 60 provided with a valve 61, to a circuit 62 comprising coil 63 disposed in series at the bottom of all or part of the elementary treatment tanks 21. This valve 61 allows to be flowed in this circuit 62, and so in these coils 63, a variable amount of hot fluid contributing to the re-heating of the treating bath.

Finally and whatever the embodiment adopted, an installation is provided which allows

- the fabric to be rid of the liquified gas which it contains under perfectly controlled conditions, particularly in so far as the temperature conditions are concerned, so as to make the recovery of the gas more economical than it is at present,
- other treatments (particularly a dyeing treatment) to be undertaken by the treating bath simultaneously with the elimination of the liquefied gas,
- formation of foam to be eliminated,
- a better distribution of temperature to be obtained along the path of the fabric,
- the limit content of liquefied gas, to be introduced into the treatment tank with the fabric, to be reduced,
- the energy consumption for maintaining the treating bath at the desired temperature to be reduced.

According to the embodiment more particularly shown in FIG. 3, an installation is provided which presents moreover the advantages

- of a better regeneration of the treating bath,
- of a reduction of condensation phenomena,
- and a simplification of the piping lay-out.

We claim:

1. An installation for the treatment of a fabric impregnated with a liquefied gas, comprising

- a treatment tank containing a treating bath,
- conveying means for conveying the fabric through the treating bath,
- heating means, for heating the treating bath, provided over all or part of the path of travel of the fabric,
- and degassing means constituted by a degassing device independent of the treatment tank and connected thereto by pipes for the circulation of the treating bath, said degassing device comprising a re-heating device acting directly on treating bath circulating therethrough for both re-heating and regenerating said treating bath through stripping of gas dissolved therein from the impregnated fabric before the bath is returned to said treatment tank.

2. An installation according to claim 1, wherein means are provided for ensuring circulation of the treating bath between the treatment tank and the degassing device with an adjustable flow.

3. An installation according to claim 1, wherein said means for heating the treating bath are arranged so that the temperature of said treating bath is higher towards the outlet for the fabric than towards the inlet for the fabric.

4. An installation according to claim 1, wherein the treating bath is contained in a single treatment tank.

5. An installation according to claim 1, wherein the treating bath is contained in several elementary treatment tanks disposed in cascade, the treating bath overflowing from one to the other.

6. An installation according to claim 1, wherein said means for heating the treating bath are formed by heating elements.

7. An installation according to claim 1, wherein the degassing device is of the falling film type and by the fact that the means for re-heating the treating bath are formed by two superposed re-heaters, disposed in this degassing device in which the treating bath to be regenerated falls on these re-heaters in the form of a film, the upper re-heater operating at a lower temperature than the operating temperature of the lower re-heater.

8. An installation according to claim 7, wherein connecting means are provided between the upper part of the treatment tank and the degassing device, said connecting means having air outlet in the degassing device between the upper heat exchanger and the lower heat exchanger.

9. An installation according to claim 8, wherein the connection means are lagged.

10. An installation according to claim 8, wherein the connection means comprise a complementary heat supply device.

11. An installation according to claim 8, wherein the connection means are formed by one or more pipes.

12. An installation according to claim 8, wherein the upper heat exchanger is formed by a condenser of the type with packing.

13. An installation according to claim 8, wherein the lower heat exchanger is formed by a falling film evaporator.

14. An installation according to claim 8, wherein the treating bath contained in the treatment tank is renewed by regenerated treating bath and by steam condensates taken from the lower heat exchanger.

15. An installation according to claim 8, wherein one or more coils are disposed at the bottom of the treatment tank(s), a hot fluid formed by regenerated treating bath and by steam condensates taken from the lower heat exchanger flowing through said coils.

16. An installation according to claim 7, wherein a liquified gas injection device is provided between the lower heat exchanger and the upper heat exchanger.

* * * * *